US006923505B2

(12) United States Patent
Siminovitch et al.

(10) Patent No.: US 6,923,505 B2
(45) Date of Patent: Aug. 2, 2005

(54) ERGONOMICALLY NEUTRAL ARM SUPPORT SYSTEM

(75) Inventors: Michael J Siminovitch, Berkeley, CA (US); Jeffrey Y Chung, Walnut Creek, CA (US); Steven Dellinges, Pacifica, CA (US); Robin E Lafever, Oakland, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/612,716

(22) Filed: Jul. 1, 2003

(65) Prior Publication Data

US 2005/0012376 A1 Jan. 20, 2005

(51) Int. Cl.[7] ..... A47C 7/54; B43L 15/00

(52) U.S. Cl. ..... 297/411.35; 297/411.36; 297/411.37; 297/411.38; 297/411.39; 248/118.1; 248/118.3; 248/118.5

(58) Field of Search ..... 297/411.35, 411.36, 297/411.38, 411.39, 411.37; 248/118.1, 118.3, 118.5, 282.1

(56) References Cited

U.S. PATENT DOCUMENTS 1,706,634 A * 3/1929 Seils ..... 297/411.35 X
3,063,752 A * 11/1962 Moore ..... 297/411.36 X
4,069,995 A * 1/1978 Miller ..... 248/118.1
5,062,676 A * 11/1991 Mars ..... 297/411.36 X
5,074,501 A * 12/1991 Holtta ..... 248/118.3
5,536,070 A 7/1996 Lemmen
5,571,274 A * 11/1996 Holstensson ..... 297/411.38
5,641,203 A 6/1997 Van De Riet et al.
5,769,497 A 6/1998 Tsai
5,884,975 A * 3/1999 Su ..... 297/411.35
5,927,815 A * 7/1999 Nakamura et al. ..... 297/411.38
6,042,064 A * 3/2000 Hong ..... 248/118.5
6,132,001 A * 10/2000 Su ..... 297/411.36
6,203,109 B1 3/2001 Bergsten et al.
6,267,336 B1 * 7/2001 Ruckstadter ..... 248/118.3
6,460,932 B1 10/2002 Kopish et al.
6,464,183 B1 * 10/2002 Bouhuijs ..... 248/118.3 X
6,502,904 B1 1/2003 Hansen
RE38,369 E * 12/2003 Ruckstadter ..... 248/118.3

FOREIGN PATENT DOCUMENTS

JP 06218013 A * 8/1994 ..... 297/411.38

* cited by examiner

*Primary Examiner*—Rodney B. White
(74) *Attorney, Agent, or Firm*—Henry P. Sartorio; Joseph R. Milner

(57) ABSTRACT

An ergonomic arm support system maintains a neutral position for the forearm. A mechanical support structure attached to a chair or other mounting structure supports the arms of a sitting or standing person. The system includes moving elements and tensioning elements to provide a dynamic balancing force against the forearms. The support structure is not fixed or locked in a rigid position, but is an active dynamic system that is maintained in equipoise by the continuous operation of the opposing forces. The support structure includes an armrest connected to a flexible linkage or articulated or pivoting assembly, which includes a tensioning element such as a spring. The pivoting assembly moves up and down, with the tensioning element providing the upward force that balances the downward force of the arm.

11 Claims, 4 Drawing Sheets

ERGONOMICALLY NEUTRAL ARM SUPPORT SYSTEM

STATEMENT REGARDING FEDERAL FUNDING

This invention was made with U.S. Government support under Contract Number DE-AC03-76SF00098 between the U.S. Department of Energy and The Regents of the University of California for the management and operation of the Lawrence Berkeley National Laboratory. The U.S. Government has certain rights in this invention.

CROSS REFERENCE TO RELATED APPLICATIONS

Not applicable.

REFERENCE TO A COMPUTER PROGRAM

Not Applicable.

BACKGROUND OF THE INVENTION

1. Field of the Invention

The invention relates generally to ergonomic devices, and more particularly to ergonomic armrest devices.

2. Description of Related Art

Ergonomics is the physical and physiological study of relationships between people and their use of machines and tools. An ergonomic device is designed to reflect human structure and function to enhance and support a person's ability to comfortably perform a task and/or operate a device or apparatus. An ergonomic device or apparatus enhances a person's performance or ability to operate a machine by reducing musculo-skeletal fatigue and injuries caused by repetitive motion or cumulative trauma. Musculo-skeletal disorders in the hand, wrist, arm and shoulder are caused by continuous and repetitious hand, wrist, or arm functions, awkward postures, forceful exertions, or a combination. In a computerized environment, personnel may spend their entire workdays at computer terminals with their forearms extended over computer keyboards or utilizing a pointer. Postal workers may spend extended periods of time with their forearms extended to operate coding machines for coding and sorting mail. Assembly-line personnel may also work with their forearms extended over articles of manufacture to manipulate tiny parts with their fingers. Often, work environments lead to severe and sometimes permanent disabling injuries. At Lawrence Berkeley National Laboratory, 60% of current reported injuries are ergonomically based within computer environments. A dynamic ergonomic arm support device would be highly advantageous in these and other workplaces.

Ergonomic armrest assemblies are known, and examples are illustrated in various prior art patents. In general, many adjustable height armrest assemblies include a support member interconnected with the seat or base of the chair and extending upwardly from the seat adjacent a side of the seat, and an armrest assembly slidably mounted to the support member. The armrest assembly typically includes an armrest and a depending tubular member defining an internal passage within which the support member is slidably received. The tubular member telescopes relative to the support member to adjust the height of the armrest relative to the seat. A movable latch is interconnected with the armrest assembly, and is selectively engageable with one of a series of spaced notches or the like formed in or on the support member. In some versions, the latch has a manually engageable trigger section that selectively moves the latch into or out of engagement with the notches. In other versions, the latch is internal and is engageable with an actuator arrangement for selectively moving the latch between engaged and disengaged positions, depending upon the position of the armrest relative to the support member One problem with some existing ergonomic arm support systems is that they have limited support and range of motion, and tend to break when leaned on. Typically, a worker may lean and exert downward pressure or weight on the cushioned or distal end of the arm of the conventional arm support which is intended for supporting only the weight of a forearm. The leverage or force exerted by the weight of such a lean or end loading is magnified by the overall length of the two arms of the jointed arm support.

Another problem is that conventional arm supports may not decrease substantially the risk of musculoskeletal disorders, such as carpal tunnel syndrome. This syndrome may be caused at least in part by the tendency of a keyboard operator to rest his or her wrists on the keyboard, or on a portion of the table immediately in front of the keyboard, while his or her hands are elevated relative to the wrists for operation of the keyboard. With the long reach of the two-arm jointed arm support, and the attendant amount of leverage, the arm cushion on the distal end of the second arm may sink to the table surface even under the relatively light weight of an arm. Even providing for height adjustment, such instability or deflection of the second arm may not provide a sufficient lift for the wrists to be held at the proper elevation relative to the hands to minimize the risk of carpal tunnel syndrome or other musculoskeletal disorders.

Computer based typing tasks involve supporting the hands over a keyboard for long periods of time. This creates significant levels of stress in the muscle areas of the wrist, forearm and elbow. The structural dynamics associated with this work environment involve holding the wrists and lower arm in a horizontal position for extended periods of time while typing. The inefficient attachment points of the muscles in the arms create a significant level of difficulty in holding the lower arm in a horizontal position. This creates a significant level of stress in the lower muscles, leading to fatigue and microtrauma.

A major problem with prior art armrests, including supposedly ergonomic systems, is that the devices are static in nature. While the armrests may be adjustable, they are adjusted into various fixed positions. The fixed position may not be optimal for all users or uses, and readjustment may be difficult or inconvenient. What is really desired is a dynamic armrest system that dynamically balances the forces and maintains an ergonomically safe position of a user's arms over a user's range of movements and upper extremity positions.

SUMMARY OF THE INVENTION

The invention is an ergonomic arm support system to maintain a neutral body position for and lower muscle effort (EMG activity) to the forearm, with minimal stress on the upper arm and shoulder, while allowing the hand to move freely over a keyboard, mouse or other workstation. A mechanical support structure external to the body maintains this neutral body position, rendering the lower arm extremity close to effectively weightless. This allows the arm and upper extremity muscles to be in a relaxed position.

The mechanical support structure is attached to a chair or other mounting structure (which may be stand alone), and supports the arms of a sitting or standing person. The system includes moving elements and tensioning elements to provide a dynamic balancing force against the forearms. The support structure is not fixed or locked in a rigid position, but is an active dynamic system that is maintained in equipoise by the continuous operation of the opposing forces. The support structure includes an armrest on which the forearm sits.

The armrest is connected to a flexible linkage or articulated or pivoting assembly, which includes a tensioning element such as a spring, that provides the balancing or counter force against the weight of the arm. The pivoting assembly is part of the support structure and is also connected to the chair or mounting structure. The pivoting assembly moves up and down, with the tensioning element providing the upward force that balances the downward force of the arm. The tensioning element may be adjustable to provide the optimum balancing force for a particular individual using the device. The pivoting assembly may also allow lateral motion of the arms over a keyboard or workstation.

Various other features, objects and advantages of the invention will be made apparent from the following description taken together with the drawings.

BRIEF DESCRIPTION OF THE DRAWINGS

The invention will be more fully understood by reference to the following drawings, which are for illustrative purposes only.

DETAILED DESCRIPTION OF THE INVENTION

The basic principle of the invention is to maintain a neutral body position including a horizontal position for the forearm with minimal stress on the upper arm and shoulder, while allowing the hand to move freely over a computer keyboard or other work surface. The invention is implemented with a mechanical support structure external to the body to maintain this neutral body position. The mechanical support structure renders the lower arm extremity close to effectively weightless. This allows the arm muscles to be in a relaxed position. By holding the lower arm and wrist area in this neutral body position with the lower arm parallel to the floor and perpendicular to the upper arm with minimal muscular involvement, the invention reduces or eliminates the potential for musculoskeletal stress and injury.

The mechanical support structure is attached to a chair, workbench or other stand or mounting structure on which a person sits or next to which a person stands or sits, and supports the arms of the person. The system includes moving elements and tensioning elements to provide a dynamic balancing force against the forearms. The support structure is not fixed or locked in a rigid position, but is an active dynamic system that is maintained in equipoise by the continuous operation of the opposing forces. The support structure includes an armrest on which the forearm sits. The armrest can be contoured like a cradle to hold the arm from sliding laterally.

The armrest is connected to a flexible linkage or articulated or pivoting assembly, which includes a tensioning element such as a spring, that provides the balancing or counter force against the weight of the arm. The pivoting assembly is part of the support structure and is also connected to the chair or stand or mounting structure. The pivoting assembly moves up and down, with the tensioning element providing the upward force that balances the downward force of the arm. The tensioning element thus provides the force to maintain the arm in the neutral position that otherwise would have to be provided by the arm muscles. When the forces are in balance, the arm becomes effectively weightless and relieves the arm and shoulder muscles from holding the arms in position. The tensioning element may be adjustable to provide the optimum balancing force for a particular individual using the device. The pivoting assembly may also allow lateral motion of the arms over a keyboard or workstation.

Figure 1:
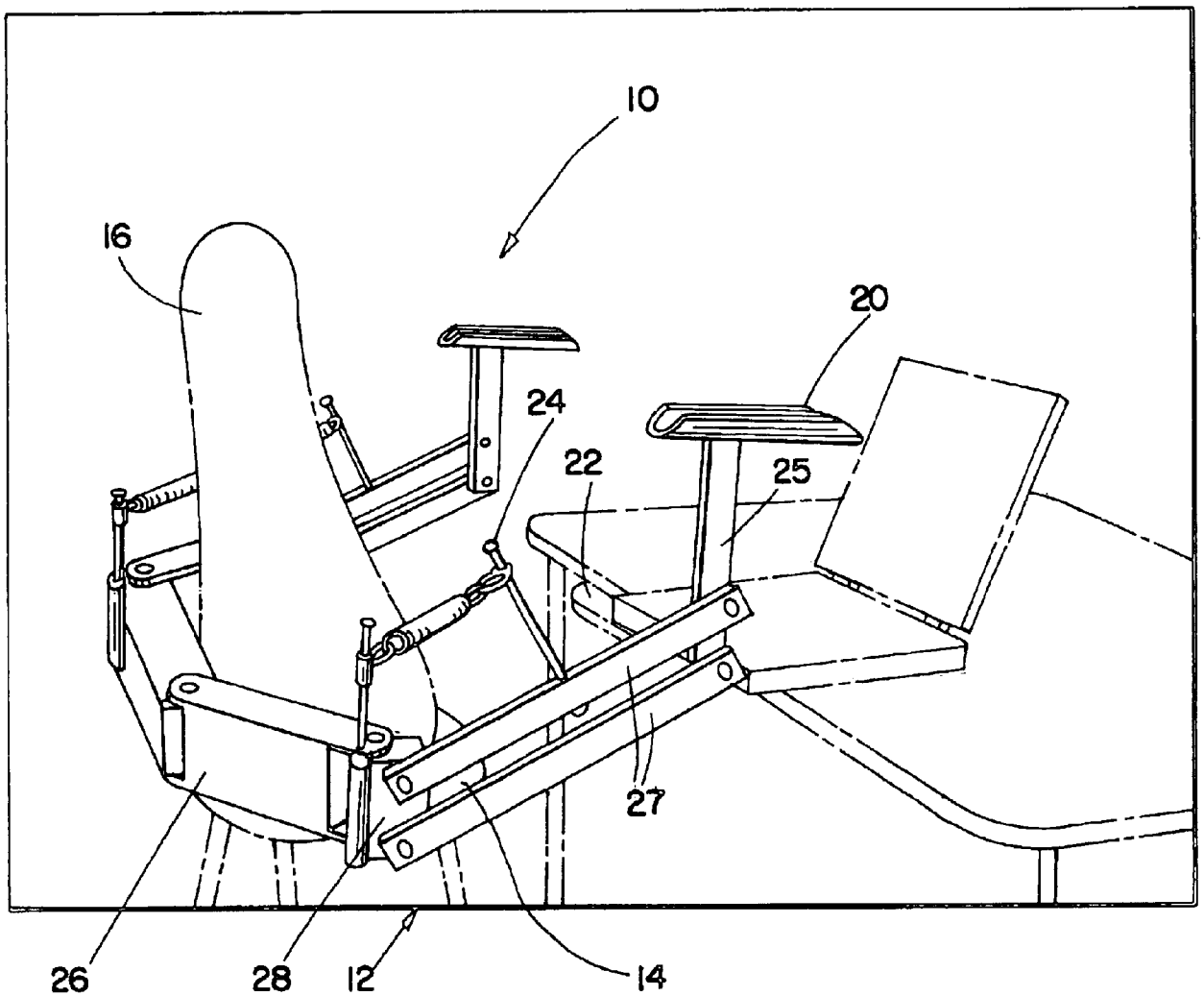
FIG. 1 is a perspective view of a chair with an ergonomic arm support of the invention.
Figure 2:
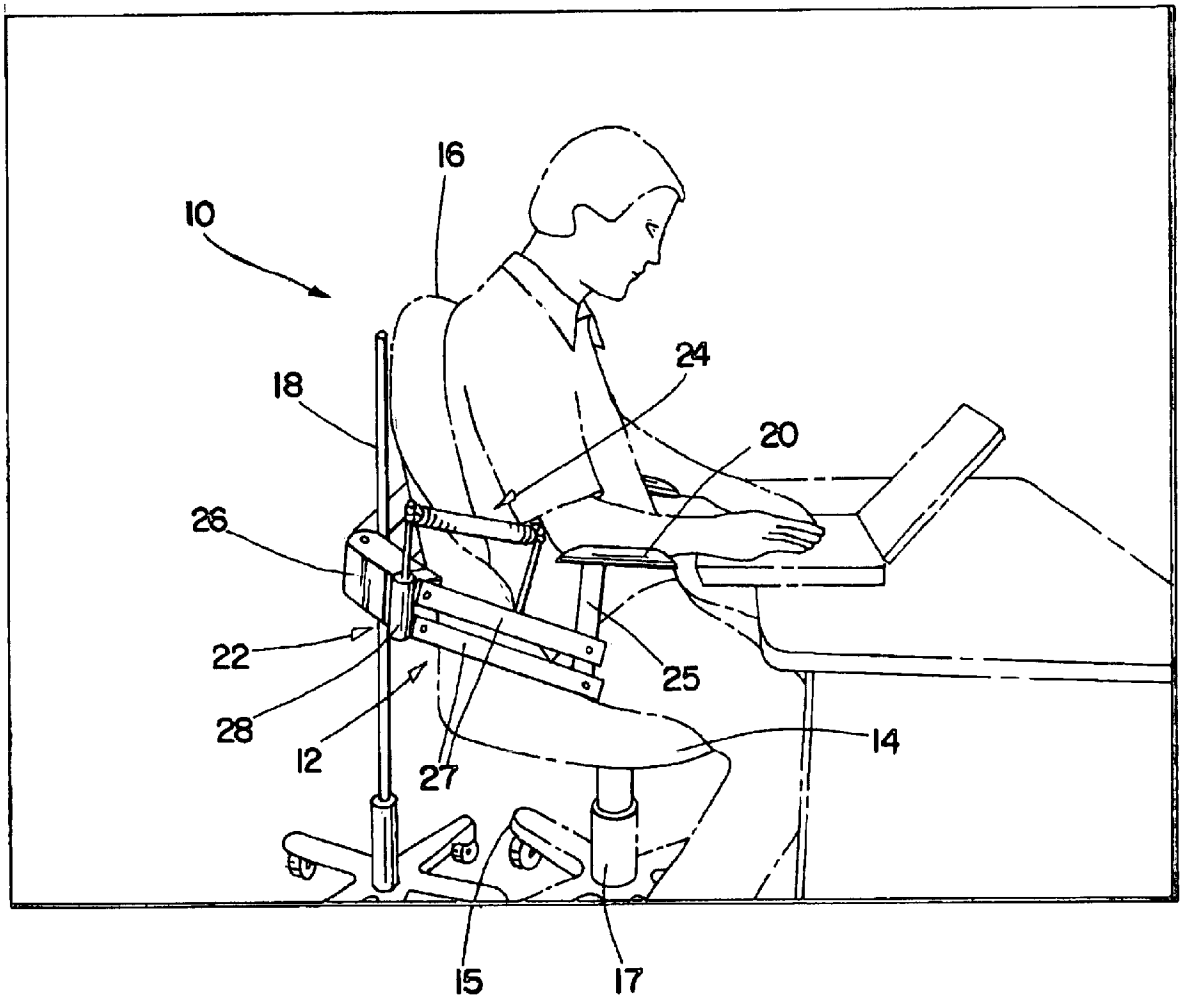
FIG. 2 is a perspective view of a chair with an ergonomic arm support of the invention supporting the forearms of a person in the chair.

FIGS. 1 and 2 are perspective views of a chair 10 having an ergonomic arm support apparatus 12 on each side of the seat 14 and back 16. The chair 10 is generally conventional in design and has a substantially horizontal seat 14 supported above the floor by a pedestal 17. Pedestal 17 represents any chair support in the form of a single post, a plurality of legs, or any type of frame, and may include wheels for moving the chair. As is known in the art, the pedestal 17 may include various adjustment means, such as a height adjustment mechanism 15, to adjust the height of the seat above the floor and its tilt for the, comfort of the user. Back 16 is at a preselected and adjustable angle to seat 14. In FIG. 1 the arm support apparatus 12 of the invention is attached to back 16 of chair 10 while in FIG. 2 it is attached to a stand alone vertical stand 18 positioned behind chair 10. Arm support apparatus 12 will generally be attached directly to chair 10, e.g. to seat 14 or back 16 or pedestal 17.

The arm support apparatus 12 includes as its principal components an armrest 20, a force transmitting mechanism 22 that transmits a compliant upward force to the armrest 20, and a force generating mechanism 24 connected to the force transmitting mechanism 22 that provides the upward compliant force. Armrest 20 may have a flat surface or a concave surface to cradle the arm. Force transmitting mechanism 22 is a flexible linkage or articulated or pivoting assembly. The force generating mechanism 24 is typically a spring but may be some other dynamic tensioning element. The spring or other tensioning element preferably can be adjusted to increase or decrease the amount of upward compliant force based on the physiology of the person using the arm support apparatus, i.e. the spring tension can be adjusted to control the upward force exerted. The arm support apparatus 12 may include a vertical support member 25 attached between armrest 20 and force transmitting mechanism 22.

Force transmitting mechanism 22 is attached to a stationary support member 26 which is connected to chair back 16 (FIG. 1) or to a separate vertical stand 18 (FIG. 2). The force transmitting mechanism could be connected directly to any stationary part of the chair itself. Force transmitting mechanism 22 is attached to the stationary support member 26 in a manner that allows the mechanism 22 to pivot in a vertical plane to provide the upward force created by the force generating mechanism.

In the illustrative embodiment, force transmitting mechanism 22 is formed of a pair of spaced parallel lever arms 27 which are pivotably attached at one end to a mounting bracket 28. The other ends of lever arms 27 are pivotably attached to vertical support member 25 to which armrest 20 is fixedly attached. Spring 24 is connected from the lever arms 27 to bracket 28 so that the spring force causes the lever arms 27 to pivot upwards. The pivoting attachment of lever arms 27 to vertical support member 25 allows the armrest 20 to remain in a substantially horizontal position for any position of the lever arms 27. By having pivotable attachments at both ends, i.e. mounting bracket 28 and vertical support member 25, and being pulled upwards by the attached force generating mechanism 24, lever arms 27 form a flexible linkage to transmit upward force to an arm resting on armrest 20.

Thus the arm support apparatus 12 is generally an articulated or pivoting assembly which provides an upward force on armrest 20 to counterbalance the downward force exerted by an arm resting thereon. FIG. 1 shows the arm support apparatus in a raised position when not in use since the spring force pulls the lever arms 27 up with no opposing downward force. FIG. 2 shows a person sitting on the chair with arms on the armrest. The arm support apparatus 12 then is in the desired equipoise position where the upward and downward forces are dynamically in balance and maintain the arm in the ergonomically desired neutral position. By properly selecting or adjusting the spring force on the force transmitting mechanism, the optimum balance condition can be achieved. However, even if the spring tension is not optimized, the apparatus is useful since an upward force is exerted on the arms and helps keep the arm in the neutral position with less muscle strain.

Mounting bracket 28 can be pivotably mounted to support member 26 which can also be pivotably mounted to stand 18 or chair 10 to allow rotation about a vertical axis so that the arm support apparatus 12 can be brought closer in or farther out from the chair depending on the needs of the person. Armrest 20 can also pivot is a horizontal plane relative to arm support apparatus 12, e.g. by being rotatably mounted to vertical support 25, so that the person's arms can rotate in a horizontal direction while performing various work tasks. Armrest 20 can also be mounted in a more complex manner to allow greater freedom of motion in the horizontal direction relative to arm support apparatus 12. For example, armrest 20 can be connected through a pair of lever arms pivotably connected to allow the armrests to translate in the horizontal direction as well as rotate.

Figure 3:
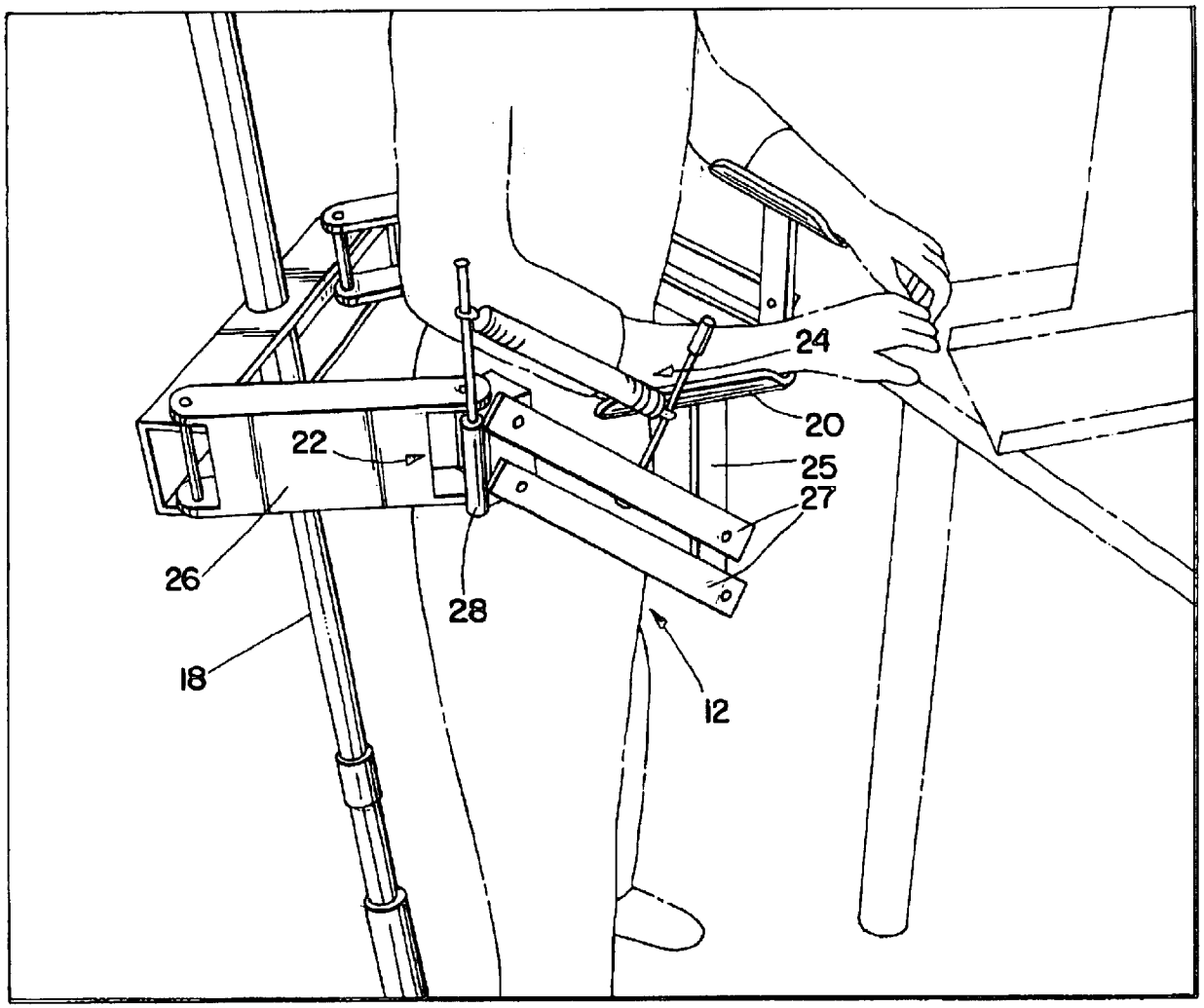
FIGS. 3 and 4 are perspective views of the ergonomic arm support of the invention used to support the forearms of a person in a standing position.
Figure 4:
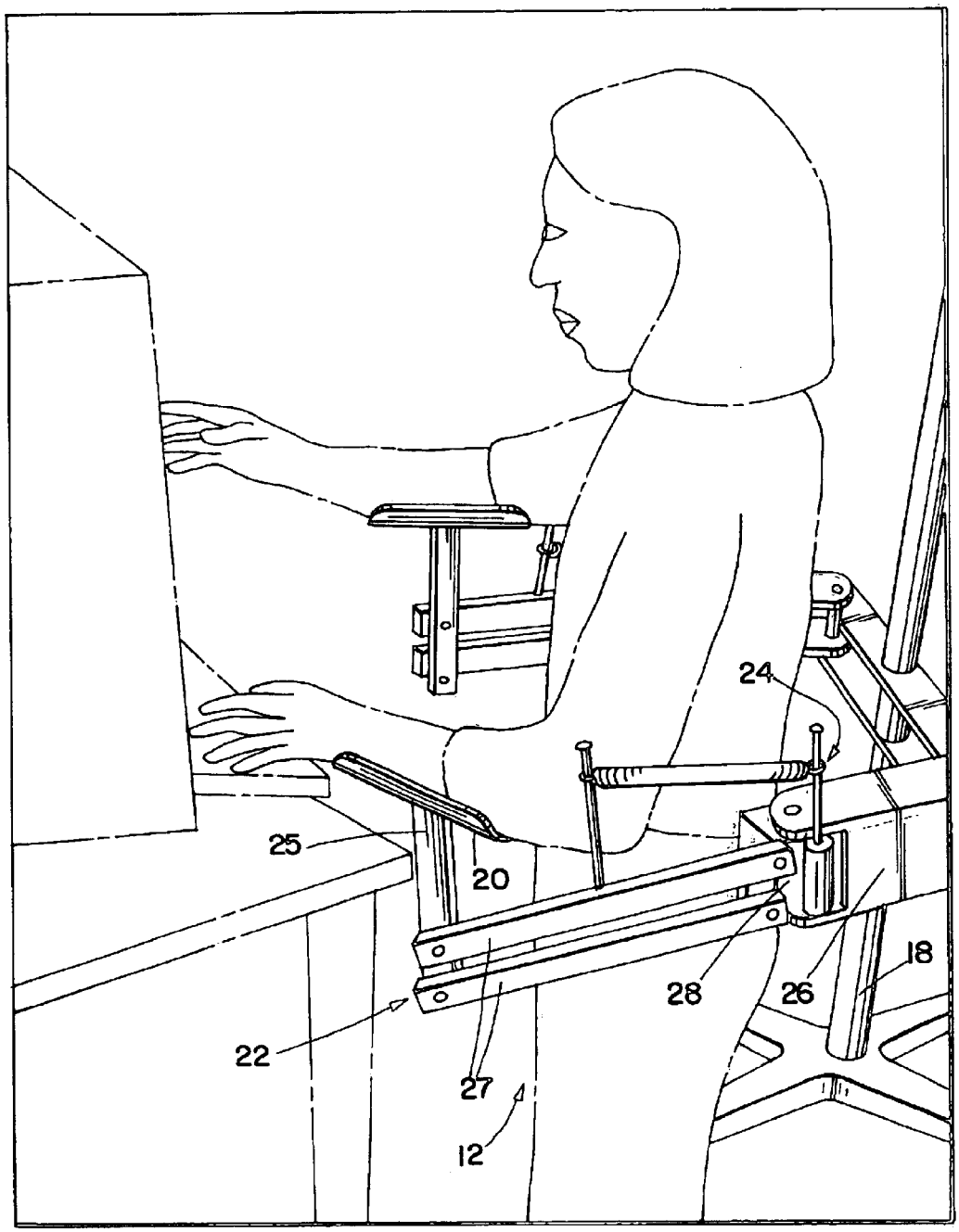

FIGS. 3 and 4 are perspective views of the arm support system 12 mounted on an adjustable base or vertical stand 18 and providing support to a person in a standing position. The structure and operation is otherwise the same as shown in FIGS. 1 and 2. The force transmitting mechanism 22 pivots at one end at mounting bracket 28 which is attached to the stationary support 26 and at the other end at vertical support member 25 to which armrest 20 is attached. Force generating mechanism 24 provides the upward force to allow the armrest 20 to remain in a substantially horizontal position when a person's forearms are placed thereon to perform a task. Since the range of vertical motion for a standing worker's arms may be greater than the more limited range required in a sitting position, the force generated by the force generating mechanism may hot be optimum for all positions, but still is a significant improvement. In a more complex embodiment, a feedback control system could be used to continuously measure the force and automatically adjust the tensioning force as required to maintain a more optimum balance of forces. A feedback tensioning adjustment system could also be used with a chair.

The present invention is not limited to the above embodiment but various modifications thereof may be made. Furthermore, various changes in form and detail may be made without departing from the scope of the present invention which is intended to be limited only by the scope of the appended claims.

We claim:

1. An ergonomic arm support apparatus comprising:

(a) an armrest having a topside and an underside;

(b) a dynamic mechanical support structure attached to said underside of said armrest that applies a compliant upward force to said armrest to provide a dynamic counterbalancing support for a forearm resting on said armrest; wherein said dynamic mechanical support structure comprises:

(i) a force transmitting mechanism, and (ii) a force generating mechanism connected to the force transmitting mechanism, wherein said force transmitting mechanism further comprises:

(1) a mounting bracket;

(2) a pair of spaced parallel lever arms pivotably attached at one end to the mounting bracket; and (3) a vertical support member pivotably attached at the other end of the pair of lever arms, the armrest being attached to the vertical support member.

2. The arm support apparatus recited in claim 1 wherein said dynamic mechanical support structure comprises a flexible linkage or an articulated or pivoting assembly and a tensioning element connected to the linkage or assembly.

3. The arm support apparatus recited in claim 2 wherein the tensioning element is a spring.

4. The arm support apparatus recited in claim 2 wherein the tensioning element is adjustable to provide a counterbalancing force to maintain the forearm in a substantially horizontal ergonomically neutral position.

5. The arm support apparatus recited in claim 1 wherein said armrest is rotationally or translationally attached to the mechanical support structure.

6. The arm support apparatus recited in claim 1 wherein the force transmitting mechanism comprises an articulated or pivoting mechanical assembly and the force generating mechanism comprises a spring.

7. The arm support apparatus recited in claim 6 wherein the spring tension is adjustable to provide a counterbalancing force to maintain the forearm in a substantially horizontal ergonomically neutral position.

8. The arm support apparatus recited in claim 1 wherein the force generating mechanism is connected between the pair of lever arms and the mounting bracket.

9. The arm support apparatus recited in claim 1 further comprising a chair, work bench, stand or mounting structure to which the mechanical support structure is attached.

10. An ergonomic chair comprising:

(a) a seat;

(b) a back;

(c) a pedestal connected to said seat; and (d) the arm support apparatus recited in claim 1 fixedly attached to said back or said seat or said pedestal.

11. An ergonomic work stand comprising:

(a) a vertical stand; and (b) the arm support apparatus recited in claim 1 fixedly attached to said vertical stand.

* * * * *